US006197411B1

(12) United States Patent
Billaud et al.

(10) Patent No.: US 6,197,411 B1
(45) Date of Patent: Mar. 6, 2001

(54) COMPOSITE, METAL MATRIX MATERIAL PART WITH A HIGH RIGIDITY AND HIGH STABILITY IN A LONGITUDINAL DIRECTION

(75) Inventors: Laetitia Billaud, Paris; Jocelyn Gaudin, Ville d'Avray; Martine Nivet Lutz, Mandelieu; Joël Poncy, Valbonne, all of (FR)

(73) Assignee: Aerospatiale Societe Nationale Industrielle, Paris (FR)

( * ) Notice: Subject to any disclaimer, the term of this patent is extended or adjusted under 35 U.S.C. 154(b) by 0 days.

(21) Appl. No.: 09/190,302

(22) Filed: Nov. 13, 1998

(30) Foreign Application Priority Data

Dec. 4, 1997 (FR) ..... 97 15306

(51) Int. Cl.[7] ..... B32B 15/04

(52) U.S. Cl. ..... 428/293.1; 428/293.7; 428/539.5; 428/294.4; 442/228; 442/376

(58) Field of Search ..... 428/293.1, 293.7, 428/539.5, 294.4; 442/228, 376

(56) References Cited

FOREIGN PATENT DOCUMENTS 0 164 536 12/1985 (EP) .
WO92/00182 1/1992 (WO) .

*Primary Examiner*—Richard Weisberger
(74) *Attorney, Agent, or Firm*—Burns, Doane Swecker & Mathis, LLP

(57) ABSTRACT

An elongated part, of composite, metal matrix material, respectively comprises 35 to 45 vol. % of a matrix based on aluminum or magnesium alloy and 65 to 55 vol. % of continuous carbon fibers, arranged in sheets parallel to the length thereof. At least approximately 90% of the carbon fibers are ultra-high modulus fibers. In 25 to 60% of the sheets, said fibers are oriented at 0%±5° with respect to the longitudinal direction of the part, when the matrix is based on aluminum. In the other sheets, the fibers are then oriented between ±20 and ±40° with respect to said direction. When the matrix is based on magnesium, the ultra-high modulus fibers are oriented at 0°±5° in at least 90% of the sheets. This gives a high rigidity and high stability in the indicated direction, which favors applications in the space industry.

13 Claims, No Drawings

COMPOSITE, METAL MATRIX MATERIAL PART WITH A HIGH RIGIDITY AND HIGH STABILITY IN A LONGITUDINAL DIRECTION

DESCRIPTION

1. Technical Field

The invention relates to an elongated part, of a composite material including an aluminium or magnesium-based metal matrix, as well as continuous carbon fibres arranged in superimposed sheet form.

Throughout the present text, the expression "continuous fibres" designates long fibres, which extend without any discontinuity from one end to the other of the part or over its entire periphery, in accordance with the orientation given to the fibres within the part.

The expression "elongated part" designates any part (plate, rod, tube, etc.) having a larger dimension in a given direction, called the "longitudinal direction", in which stresses are to be transmitted.

The term "sheet" designates by convention any layer of woven or unwoven fabrics, no matter the way in which it is made (draping, winding, etc.).

The composite, metal matrix material part according to the invention is particularly appropriate for uses in the space industry and, more generally, for any use involving a high dimensional stability.

2. Prior Art

The different structural parts of satellites, probes and other craft to be used in space are subject to particularly severe, more especially mechanical and thermal stresses.

Thus, during assembly and testing on the ground, very careful monitoring is required of the effects of gravity, humidity and temperature.

During the launch phase, the launcher transmits to the spacecraft intense vibrations and thrust forces.

Finally, when the craft is operational, it is subject to very significant temperature changes, depending on whether or not its different faces are illuminated by the sun. To this is added the placing under vacuum of the craft, which can lead to moisture being given off.

In the presence of all the aforementioned stresses and constraints, the production of structural parts causes a difficult problem, particularly when they are used for supporting high precision equipment, such as mirrors belonging to optical systems.

In this context, at present there is no material which, in itself, has an adequate dimensional stability and rigidity to produce structural parts able to withstand the aforementioned stresses, whilst still ensuring the requisite positioning precision. This is why heat regulators of varying complexity are sometimes associated with such parts.

Thus, metal parts always have a non-zero expansion coefficient, which leads to a positioning instability when the part undergoes temperature variations. The rigidity of purely mechanical parts is also generally inadequate for the considered application.

Composite, metal matrix material parts are much less sensitive to temperature variations and can have a high rigidity in the longitudinal direction of the part. However, they suffer from the important disadvantage that when entering vacuum, they progressively desorb the water which they had adsorbed when on earth. This progressive desorption leads to dimensional variations in the part. It requires the following of very prejudicial procedures during the manufacture of the spacecraft. It also leads to the equipping of said craft with devices of varying complexity permitting the repositioning of high precision equipment, when in space. However, these are difficult and energy-consuming operations, which can affect the reliability of the craft and reduce its service life.

The use of composite metal matrix material parts makes it possible, due to the presence of continuous fibres, to significantly increase the rigidity compared with purely metal parts. Moreover, the problems of dimensional variations due to desorption in vacuum are eliminated. These advantages are more particularly described in the article "High Stable Advanced Materials For Space Telescope, An Application of Metal Matrix Composites" by C. Désagulier et al., IAF-96-I.3.01, in the case of composite carbon-aluminium and carbon-magnesium fibres. More specifically, this article recommends the use of ultra-high modulus carbon fibres and states that a sheet or element "ply" having a longitudinal, thermal expansion coefficient $\alpha L$ of $1.10^{-6}/°$ C. (magnesium matrix) or $1.27.10^{-6}/°$ C. (aluminium matrix) and a longitudinal tension modulus EL of 280 GPa (magnesium matrix) or 302 GPa (aluminium matrix) could be obtained.

However, no procedure is suggested with regards to the production of a thick part (group of sheets) having to have longitudinal thermal expansion coefficient $\alpha L$ of virtually zero, i.e. whose absolute value is preferably below $0.2.10^{-6}/°$ C.

DESCRIPTION OF THE INVENTION

The invention specifically relates to a composite, metal matrix material part, whose original design makes it possible to have both a high rigidity and a high dimensional stability, so as to be usable in space, in order to support there high precision equipment.

According to a first embodiment of the invention, this result is obtained by means of a composite, metal matrix material part, which is elongated in a given direction, characterized in that it comprises 35 to 45 volume % of an aluminium-based alloy matrix and, respectively, 65 to 55 volume % of continuous carbon fibres arranged as successive sheets parallel to said direction, at least approximately 90% of the carbon fibres being ultra-high modulus fibres, said ultra-high modulus fibres being oriented at 0°±5° in approximately 25% to approximately 60% of the sheets, and beteween±20° and±40° in the other sheets, with respect to said direction.

In this case, the aluminium-based alloy matrix is preferably of an AG10-type alloy, containing approximately 10 vol. % magnesium.

Advantageously, the ultra-high modulus fibres are then oriented at 0°±5° in 45 to 55% of the sheets and preferably in approximately 50% of the sheets.

Moreover, the ultra-high modulus fibres are advantageously oriented at approximately±25° in the other sheets.

According to a second embodiment of the invention, the sought features are obtained by means of a composite, metal matrix material part, elongated in a given direction, characterized in that it comprises, respectively, 35 to 45 volume % of a magnesium-based alloy matrix and 65 to 55 volume % of continuous carbon fibres, arranged in successive sheets parallel to said direction, at least approximately 90% of the carbon fibres being ultra-high modulus fibres, said ultra-high modulus fibres being oriented at 0°±5° relative to said direction in at least 90% of the sheets.

In this case, the magnesium-based alloy matrix is preferably a GA9Z1-type alloy, containing approximately 9 vol. % aluminium.

Advantageously, the ultra-high modulus fibres are then oriented at 0°±5° in approximately 100% of the sheets.

In both embodiments, the parts have a virtually perfect stability, at least in the longitudinal direction. Thus, as with all metal parts or those having a metal matrix, there is no moisture adsorption on the ground, so that these dimensions do not change when the part is placed in a vacuum. Moreover, due to the characteristics inherent in the material according to the invention, the thermal expansion coefficient $\alpha L$ in the longitudinal direction is substantially zero. Thus, its absolute value is below $0.2.10^{-6}$/° C., or close thereto.

A part according to the invention also has a high specific rigidity in the aforementioned longitudinal direction. More specifically, the specific rigidity in said direction being defined as the ratio between the longitudinal tension modulus EL and the relative density $\rho$, in most cases said ration exceeds 100 MPa.

Preferably, at least some of the sheets are fabrics, e.g. of the taffeta type, comprising approximately 90% warp yarns, constituted by the continuous carbon fibres with an ultra-high modulus and approximately 10% weft yarns, constituted by other continuous carbon fibres with a lower modulus. The weft yarns have the particular function of holding or maintaining the warp yarns.

In the preferred embodiments of the invention, the ultra-high modulus fibres have a tension modulus at least equal to approximately 650 GPa and which extend from one end to the other of the part, in accordance with the longitudinal direction thereof.

Preferably, the sheets are arranged in accordance with a mirror symmetry with respect to a median, longitudinal surface parallel to the longitudinal direction.

DETAILED DESCRIPTION OF PREFERRED EMBODIMENTS OF THE INVENTION

According to the invention, so that an elongated part has both a very high specific rigidity and a virtually perfect dimensional stability in the direction of its length, said part must be produced from a composite metal matrix material having clearly defined characteristics. The expression "very high specific rigidity in the direction of its length", means a ratio between the tension modulus EL and the relative density $\rho$, which generally exceeds 100 GPa in said direction. In the above-described, preferred embodiments, this objective is achieved because the specific rigidity measured in the longitudinal direction is, as a function of the particular case, 119 GPa (aluminium-based matrix) or 197 GPa (magnesium-based matrix).

In comparable manner, the expression "virtually perfect dimensional stability in the direction of its length" means that the absolute value of the longitudinal thermal expansion coefficient $\alpha L$ is generally below $0.2.10^{-6}$/° C. In the preferred embodiments, this result is also achieved, because the absolute value of the longitudinal thermal expansion coefficient measured is, as a function of the particular case, $0.08.10^{-6}$/° C. (aluminium-based matrix) or $0.01.10^{-6}$/° C. (magnesium-based matrix).

According to the invention, the composite material used for producing an elongated part comprises a magnesium or aluminium-based alloy matrix, as well as continuous carbon fibres arranged in the form of successive sheets, parallel to the longitudinal direction of the part.

More specifically, the matrix and the fibres respectively form approximately 40% and approximately 60% of the total volume of the part. If the part comprises one or more inserts made from another material, e.g. a metallic material, said volume proportion only applies to the portion of the part made from composite material. In practice, the expressions "approximately 40%" and "approximately 60%" signify that the matrix represents 35 to 45% of the total volume of the part and the fibres represent respectively 65 to 55% of said volume.

In a first, preferred embodiment of the invention, the alloy in which the matrix is produced is an aluminium alloy containing approximately 10 vol. % magnesium. Such an alloy is generally known under the name "AG10 alloy".

In said first embodiment, at least approximately 90% of the continuous carbon fibres are ultra-high modulus fibres, i.e. fibres with a tension modulus of at least approximately 650 GPa. More specifically, the continuous carbon fibres are MITSUBISHI "K139" fibres.

The ultra-high modulus carbon fibres are also oriented between −5° and +5° with respect to the longitudinal direction of the part in 45 to 55% of the sheets. In the remaining sheets, i.e. respectively in 55 to 45% of the sheets, the ultra-high modulus carbon fibres are alternately oriented in one or other direction between 20 and 40° relative to the longitudinal direction of the part.

In the first, preferred embodiment, the part has an even number of sheets of fibres and said sheets are arranged in accordance with a mirror symmetry with respect to the median, longitudinal surface of the part and parallel to said longitudinal direction. Said surface is planar or cylindrical, depending on whether the part has a rectangular or circular cross-section.

In each of the sheets, the ultra-high modulus fibres are parallel to one another and extend from one end to the other of the part, in the longitudinal direction of the latter.

A part according to the invention is manufactured by firstly producing a fibrous preform and then infiltrating said preform with the alloy forming the matrix. The production of the fibrous preform is dependent on the shape of the part to be manufactured. In particular, the ultra-high modulus fibres can be used alone (in the case of winding), in association with other fibres (in the case of a fabric), or by combining these two processes.

When all the sheets are formed solely from ultra-high modulus fibres, which are parallel to one another in each sheet, all the carbon fibres forming the fibrous matrix are of ultra-high modulus fibres. Conversely, when all the sheets are in the form of a fabric, in which the ultra-high modulus fibres constitute the warp yarn, approximately 90% of the fibres of the fibrous matrix are ultra-high modulus fibres. In certain cases, part of the sheets is formed solely from ultra-high modulus fibres and the other sheets are formed from fabrics. As a function of the percentage of sheets of each category, the percentage of ultra-high modulus fibres in the fibrous preform is then between approximately 90 and 100%.

In the case of the example described, the ultra-high modulus fibres are woven in order to mutually support said fibres in the sheet in question, so as to ensure a satisfactory manufacture of the part. In order to ensure this support, a fabric is produced, e.g. of the taffeta type, comprising approximately 90% warp yarns constituted by ultra-high modulus carbon fibres and approximately 10% weft yarns, constituted by other continuous carbon fibres with a lower modulus. In the first embodiment described, said other fibres are TORAY type "M40" or "M50".

A composite, metal matrix part according to the invention is manufactured by casting under pressure. According to this procedure, in the same hermetic container, comparable to an autoclave, is placed a crucible containing blocks of the alloy for forming the matrix of the part, together with a mould into which has been introduced beforehand the fibrous preform previously manufactured in accordance with the arrangement described hereinbefore.

During a first stage, the vacuum is formed within the container and the mould, the crucible containing the metal alloy blocks is heated and the mould preheated.

When the alloy contained in the crucible has completely melted, it is transferred into the interior of the mould. This transfer takes place automatically by pressurizing the container to a pressure level generally between approximately 30 and approximately 100 bars.

As soon as the mould has been filled, the cooling of the part is accelerated by bringing a cooling member into contact with a wall of the mould. For as long as the temperature has not dropped below the solidification temperature of the alloy, the pressure is maintained in the container, so as to compensate the natural shrinkage of the metal.

For further details concerning the known, technical principles of performing this process, reference should be made to the article "Pressure Infiltration Casting of Metal Matrix Composites" by Arnold J. COOK and Paul S. WERNER in "Materials Science and Engineering " A 144, October 1991, pp 189–206.

In the first embodiment of the invention, six different parts, numbered 1 to 6, made from composite, metal matrix material and having an elongated, parallelepipedic shape, were manufactured by casting under pressure. The parts numbered 1 to 5 had the same dimensions: 260 mm×130 mm×3 mm. Part 6 had dimensions: 160 mm×80 mm×3 mm. All the parts had the same AG10 matrix. They essentially differed by the structure of their fibrous preform. Thus, if each of these preforms was formed from sixteen (parts 1 to 5) or ten (part 6) fabric sheets, each including 90% K139 fibres and 10% M40 fibres (parts 1 to 5) or M50 fibres (part 6), the orientation of the ultra-high modulus K139 fibres would differ between the individual preforms. This orientation is given in table I.

TABLE I

| Part No. | Draping (fibre K139) | Draping sequence |
|---|---|---|
| 1 | quasi-unidirectional | |
| 2 | 25% of fibres at 0°<br>75% of fibres ± 30° | (+30°;+30°;+30°;0°;−30°;−30°;°30°;0°;<br>0°;−30°;−30°;−30°;0°;+30°;+30°;+30°) |
| 3 | 25% of fibres at 0°<br>75% of fibres ± 22° | (+22°;+22°;+22°;0°;−22°;−22°;−22°;0°;<br>0°;−22°;−22°;0°;+22°;+22°;+22°) |
| 4 | 50% of fibres at 0°<br>50% of fibres ± 30° | (−30°;0°;+30°;0°;−30°;0°; +30°;0°;0°;<br>+30°;0°;−30°;0°;+30°;0°;−30°) |
| 5 | 50% of fibres at 0°<br>50% of fibres ± 25° | (−25°;0°;+25°;0°;−25°;0°;+25°;0°;0°<br>+25°;0°;−25°;0°;+25°;0°;−25°) |
| 6 | 60% of fibres at 0°<br>40 of fibres ± 32° | (0;32°;0°;−32°;0;0;−32°;0;32°;0) |

The preforms defined in table I correspond to reference parts, making it possible to demonstrate the importance of the orientation of the fibres within the composite material, with a view to obtaining the desired result.

On the basis of the thus produced preforms, each of the parts was then produced using casting under pressure, under identical production conditions, which are as follows:

temperature of the metal bath constituted by the AG10 aluminium alloy : 720° C.;

preform temperature : 670° C.;

maximum infiltration pressure : 60 bars;

pressure rise : 1 bar/s;

average cooling rate : approximately 50° C./min.

Testpieces were then cut using a diamond grinding wheel in each of the thus obtained parts, to make it possible to perform mechanical tests and physical measurements.

Prior to the cutting of the testpieces, the quality of the infiltration of the fibrous preforms by the alloy was monitored both by X-radiography and metallographic observations. These checks revealed a very good infiltration of the preform and the absence of casting defects.

The mechanical tests performed on the testpieces machined in the parts are mainly tensile tests. The physical measurements particularly concern the thermal expansion coefficient in the transverse direction, the thermal expansion coefficient in the longitudinal direction and the fibre volume fraction.

The physical measurements revealed that the volume mass of the composite was always between 2.26 and 2.30 g/cm$^3$.

The results of the mechanical tests and physical measurements performed on each of the test pieces at ambient temperature (approximately 20° C.), appear in table II.

TABLE II

| MEASURED CHARACTERISTICS | SYMBOL | PART 1 | PART 2 | PART 3 | PART 4 | PART 5 | PART 6 |
|---|---|---|---|---|---|---|---|
| Young's modulus, L-direction (GPa) | EL | 360 (2) | 166 (2) | 215 (2) | 226 (2) | 275 (2) | 282 (3) |
| Absolute value of thermal expansion coefficient, L-direction (10−6/° C.) | αL | 0.47 (2) | 0.25 (2) | 0.23 (2) | 0.1 | 0.08 (2) | 0.26 (4) |
| Absolute value of the thermal expansion coefficient, T-direction (10−6/° C.) | αT | 8.2 (1) | 6.9 (1) | 6.9 (1) | 8.2 (1) | 9.0 (1) | 4.53 (3) |
| Fibre volume (%) | Vf | 60.3 +/− 0.3 (5) | 50.8 +/− 0.2 (5) | 59.5 +/− 0.3 (5) | 55.7 +/− 0.3 (5) | 59.4 +/° 0.5 (5) | 57 ± 1.02 (1) |

In the above table, the expression "L direction" stands for longitudinal direction, the expression "T direction" the transverse direction and the values given in brackets indicate the number of tests performed on each occasion.

The results in table II show that the thermal expansion coefficient αL in the longitudinal direction decreases progressively in absolute values, from part 1 to part 5, parts 2, 3 and 6 having a substantially identical, thermal expansion coefficient in said direction. Only parts 4 and 5 have a coefficient L lower than $0.2.10^{-6}$/° C. in the longitudinal direction. Only parts 1, 5 and 6 have a specific rigidity in the longitudinal direction EL/ρexceeding 100 GPa.

In the first embodiment of the invention, part 5 consequently represents the best compromise for obtaining both a high rigidity and a high stability in the longitudinal direction.

In a second, preferred embodiment of the invention, the matrix is made from a magnesium-based alloy, containing approximately 9 vol. % aluminium. This alloy is of the high purity GA9Z1 type.

As in the first embodiment described, the matrix and the continuous carbon fibres have respective volume fractions of approximately 40 and approximately 60%.

In the example chosen to illustrate this second embodiment of the invention, a preform is produced from a pile or stack of fabric sheets. The fabric comprises approximately 90 vol. % ultra-high modulus carbon fibres of type K 139, placed in the longitudinal direction, and 10% type M50 carbon fibres, placed in the transverse direction, for supporting the K139 fibres.

The stack of fabric sheets is produced in such a way that, in all the sheets, the ultra-high modulus fibres are oriented at 0°±5° relative to the longitudinal direction of the part.

As in the first embodiment described, the part is manufactured by casting under pressure, using the following conditions:

temperature of the GA9Z1 magnesium alloy bath : 750° C.;

preform temperature : 750° C.;

maximum infiltration pressure : 60 bars;

pressure rise: 1 bar/s;

average cooling rate : approximately 25° C./min.

Samples of the part obtained, called "part 7"were cut in order to perform the same mechanical and physical measurements as on parts 1 to 6 illustrating the first embodiment of the invention.

The volume mass of part 7 was determined as 1.95 g/cm$^3$ by physical measurements.

At ambient temperature (approximately 20° C.), table III gives the results of the mechanical and physical measurements performed (the notations are the same as in table II).

TABLE III

| Measured characteristics | Symbol | Part 7 |
|---|---|---|
| Young's modulus, L-direction (GPa) | EL | 384 (3) |
| Absolute value of thermal expansion coefficient, L-direction (10-6/° C.) | αL | 0.01 (4) |
| Absolute value of thermal expansion coefficient, T-direction (10-6/° C.) | αT | 5.33 (3) |
| Fibre volume (%) | Vf | 58.5 ± 2.5 (3) |

Examination of table III shows that the part 7 has, in absolute values, a thermal expansion coefficient αL, in the longitudinal direction, well below $0.2.10^{-6}$/° C. The specific rigidity EL/ρ in the longitudinal direction also well exceeds 100 GPa. Thus, the sought objectives are also attained by the second embodiment of the invention when the orientation of the fibres is at 0°±5° in at least 90% of the sheets.

In conclusion, the composite, metal matrix material parts according to the invention have mechanical and physical characteristics permitting the envisaging of their use in the space industry, for all applications requiring both a high rigidity and an excellent stability in a longitudinal direction of the part.

What is claimed is:

1. Composite, metal matrix material part, which is elongated in a given direction, comprising 35 to 45 volume % of an aluminium-based alloy matrix and, respectively, 65 to 55 volume % of continuous carbon fibres arranges as successive sheets parallel to said direction, at least approximately 90% of the carbon fibres being ultra-high modulus fibres, said ultra-high modulus fibres being oriented at 0°±5° in approximately 25% to approximately 60% of the sheets, and between ±20°and ±40° in the other sheets, with respect to said direction.

2. Part according to claim 1, wherein the matrix is of an aluminium-based alloy containing approximately 10 vol. % magnesium.

3. Part according to claim 1, wherein the ultra-high modulus fibres are oriented at 0°±5° in 45 to 55% of the sheets.

4. Part according to claim 3, wherein the ultra-high modulus fibres are oriented at 0°±5° in approximately 50% of the sheets.

5. Part according to claim 1, wherein the ultra-high modulus fibres are oriented at approximately ±25° in the other sheets.

6. Composite, metal matrix material part, elongated in a given direction, comprising, respectively, 35 to 45 volume % of a magnesium-based alloy matrix and 65 to 55 volume % of continuous carbon fibres, arranged in successive sheets parallel to said direction, at least approximately 90% of the carbon fibres being ultra-high modulus fibres, said ultra-high modulus fibres being oriented at 0°±5° relative to said direction in at least 90% of the sheets.

7. Part according to claim 6, wherein the matrix is of magnesium-based alloy containing approximately 9 vol. % aluminium.

8. Part according to claim 6, wherein the ultra-high modulus fibres are oriented at 0°±5° in approximately 100% of the sheets.

9. Part according to claim 1, wherein at least some of the sheets are fabrics comprising approximately 90% warp yarns, constituted by said continuous, ultra-high modulus, carbon fibres and approximately 10% weft yarns, constituted by other continuous carbon fibres with a lower modulus.

10. Part according to claim 1, wherein the ultra-high modulus fibres extend from one end to the other of the part, in accordance with said direction.

11. Part according to claim 1, wherein the ultra-high modulus fibres are fibres having a tension modulus of at least approximately 650 GPa.

12. Part according to claim 1, wherein the sheets are arranged in accordance with a mirror symmetry with respect to a median, longitudinal surface, parallel to said direction.

13. Part according to claim 1, belonging to a spacecraft.

* * * * *